US009867519B2

(12) United States Patent
Kim et al.

(10) Patent No.: US 9,867,519 B2
(45) Date of Patent: Jan. 16, 2018

(54) DISHWASHER

(71) Applicant: LG Electronics Inc., Seoul (KR)

(72) Inventors: Daegyu Kim, Seoul (KR); Byeonghyeon Ju, Seoul (RE); Shinwoo Han, Seoul (KR); Joonho Pyo, Seoul (KR); Younghwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 768 days.

(21) Appl. No.: 13/917,740

(22) Filed: Jun. 14, 2013

(65) Prior Publication Data

US 2014/0102492 A1 Apr. 17, 2014

(30) Foreign Application Priority Data

Sep. 19, 2012 (KR) ..... 10-2012-0103852
Sep. 25, 2012 (KR) ..... 10-2012-0106357
Sep. 25, 2012 (KR) ..... 10-2012-0106358

(51) Int. Cl.
*A47L 15/42* (2006.01)
*A47L 15/23* (2006.01)
*A47L 15/50* (2006.01)

(52) U.S. Cl.
CPC ..... *A47L 15/23* (2013.01); *A47L 15/428* (2013.01); *A47L 15/4221* (2013.01); *A47L 15/508* (2013.01)

(58) Field of Classification Search
CPC ..... A47L 15/4221; A47L 15/482; A47L 15/4282; A47L 15/16; A47L 15/18;
(Continued)

(56) References Cited

U.S. PATENT DOCUMENTS 3,144,034 A * 8/1964 Lyman ..... A47L 15/23 134/176
3,368,573 A * 2/1968 Mixon ..... A47L 15/23 134/176

(Continued)

FOREIGN PATENT DOCUMENTS

CN 101795613 A 8/2010
CN 102204804 A * 10/2011 ..... A47L 15/23

(Continued)

OTHER PUBLICATIONS

Machine English Translation of Description of WO 2011/132358 (Kajiura, Oct. 2011).*

(Continued)

*Primary Examiner* — Joseph L Perrin
*Assistant Examiner* — Irina Graf
(74) *Attorney, Agent, or Firm* — Fish & Richardson P.C.

(57) ABSTRACT

A dishwasher is disclosed that includes a tub, an upper rack and a lower rack arranged in the tub and configured to receive objects a lower arm, a water supply pump configured to supply water to the lower arm chamber, a tower nozzle included in the lower rack and configured to inject water to the upper rack, a tower connection part detachable from the detachable pipe chamber and configured to connect and supply water to the tower nozzle based on being detached from the detachable pipe chamber, and a channel change unit provided in the lower arm chamber configured to alternately open (i) the chamber communication hole and (ii) an arm channel communication hole based on water pressure inside the lower arm chamber.

14 Claims, 14 Drawing Sheets

(58) Field of Classification Search
CPC ..... A47L 15/42; A47L 15/4214; A47L 15/23; A47L 15/428; A47L 15/508
See application file for complete search history.

(56) References Cited

U.S. PATENT DOCUMENTS

| | | | | |
|---|---|---|---|---|
| 3,570,506 | A * | 3/1971 | Reifenberg | A47L 15/428 134/183 |
| 3,648,931 | A | 3/1972 | Jacobs | |
| 3,951,683 | A | 4/1976 | Jarvis, Jr. et al. | |
| 4,174,723 | A | 11/1979 | Long | |
| 4,509,687 | A | 4/1985 | Cushing | |
| 5,427,129 | A | 6/1995 | Young | |
| 5,546,968 | A * | 8/1996 | Jeon | A47L 15/23 134/179 |
| 5,697,392 | A * | 12/1997 | Johnson | A47L 15/23 134/176 |
| 5,954,073 | A | 9/1999 | Tobbe | |
| 2007/0119488 | A1* | 5/2007 | Kwon | A47L 15/4221 134/198 |
| 2008/0271765 | A1 | 11/2008 | Burrows | |
| 2009/0090400 | A1 | 4/2009 | Burrows | |
| 2012/0318389 | A1* | 12/2012 | Holstein | A47L 15/4221 137/625 |

FOREIGN PATENT DOCUMENTS

| | | | | |
|---|---|---|---|---|
| DE | 4215574 | | 11/1993 | |
| EP | 1232720 | A2 * | 8/2002 | A47L 15/428 |
| EP | 2 522 268 | A1 | 11/2012 | |
| EP | 2 656 772 | A2 | 10/2013 | |
| FR | 2549363 | | 1/1985 | |
| GB | 2233220 | A * | 1/1991 | A47L 15/23 |
| GB | 2253341 | | 9/1992 | |
| JP | 08-056885 | A | 3/1996 | |
| WO | WO 2008/137818 | A1 | 11/2008 | |
| WO | WO 2008/137820 | A1 | 11/2008 | |
| WO | WO 2011/132358 | A1 | 10/2011 | |

OTHER PUBLICATIONS

Search Report issued in French Application No. 1356211 dated Jan. 19, 2016, 12 pages (with English translation).
Office Action issued in German Application No. 102013218677.0 dated Feb. 16, 2016, 15 pages (with English translation).
UK Office Action dated Mar. 4, 2015 for UK Application No. 1310177.9, 6 pages.
Chinese Office Action dated Sep. 15, 2015 for Chinese Application No. 201310220385.8, with English Translation, 14 Pages.
UK Office Action dated Sep. 18, 2013 for Application No. 1310177.9, 6 pages.

* cited by examiner (a)

(b)

(a)

(b)

(a)

(b)

DISHWASHER

CROSS-REFERENCE TO RELATED APPLICATIONS

Pursuant to 35 U.S.C. §119(a), this application claims the benefit of earlier filing date and right of priority to Korean Application Nos. 10-2012-0103852, filed on Sep. 19, 2012, 10-2012-0106358 filed on Sep. 25, 2012, and 10-2012-0106357 filed on Sep. 25, 2012, the contents of which are hereby incorporated by reference herein in their entirety.

FIELD

The present disclosure relates to a dishwasher.

BACKGROUND

Generally, a dishwasher is an electric appliance configured to wash or dry objects, namely, dishes held in a washing room by using washing water.

FIG. 1 is a diagram of a conventional dishwasher. Such a conventional dishwasher includes a cabinet 200 in which a tub 210 for providing a washing room is arranged, upper and lower racks 220 and 230 provided in the tub to place washing objects thereon, a sump 240 arranged under the tub 210 to store the washing water therein, a lower arm 260 for injecting the washing water toward the lower rack, an upper arm 250 for injecting the washing water to the upper rack, a pump (P) for supplying the washing water stored in the sump 240 to the lower arm 260 via a first passage (P1), and a second passage (P2) branched from the first passage through a valve (V) to supply the washing water to the upper arm 250.

The sump 240 is supplied with the washing water via a water supply passage 241 and it has the washing water held therein drained via a drainage passage 243. The second passage (P2) is supplied the washing water drawn via the first passage (P1) to supply the washing water to the upper arm 250.

The upper arm 250 provided in the conventional dishwasher may be arranged between the upper rack 220 and the lower rack 230, to wash the washing objects held on the upper rack. Accordingly, a predetermined space is provided between the upper rack 220 and the lower rack 230 to arrange the upper arm 250 therein.

The size of an object that can be placed in the racks 220 or 230 may be limited by the placement of the upper arm 250. Furthermore, the size of the racks may be limited by the presence of the upper arm 250.

Moreover, the second passage (P2) may limit the size and position of the racks 220 and 230.

SUMMARY OF THE DISCLOSURE

According to an innovative aspect of the subject matter described in this specification a dishwasher includes a tub; an upper rack and a lower rack arranged in the tub and configured to receive objects; a lower arm includes a lower arm chamber configured to draw water into the lower arm chamber; a detachable pipe chamber configured to communicate with the lower arm chamber via a chamber communication hole; and an arm channel that is in communication with the lower arm chamber and that is configured to inject water to the lower rack; a water supply pump configured to supply water to the lower arm chamber; a tower nozzle included in the lower rack and configured to inject water to the upper rack; a tower connection part detachable from the detachable pipe chamber and configured to connect and supply water to the tower nozzle based on being detached from the detachable pipe chamber; and a channel change unit provided in the lower arm chamber configured to alternately open (i) the chamber communication hole and (ii) an arm channel communication hole based on water pressure inside the lower arm chamber.

These and other embodiments can each optionally include one or more of the following features. The channel change unit includes a change unit body configured to reciprocate and rotate in the lower arm chamber based on the water pressure inside the lower arm chamber; a chamber opening hole in the change unit body configured to open the chamber communication hole based on a rotational angle of the change unit body; and an arm channel opening hole in the change unit body configured to open the arm channel communication hole based on the rotational angle of the change unit body. The channel change unit further includes a flange that extends along an outer circumferential surface of the change unit body and is configured to guide the change unit body during reciprocation and rotation by contacting an inner circumferential surface of the lower arm chamber.

The lower arm chamber includes an inlet hole configured to draw water into the lower arm chamber; a lower gear coupling portion configured to cover the inlet hole; and an upper gear coupling portion that is beyond the lower gear coupling portion. The channel change unit further includes an upper gear that is in a top surface of the change unit body and is coupled to the upper gear coupling portion, the upper gear being configured to operate one of the chamber opening hole and the arm channel opening hole to open one of the chamber communication hole and the arm channel communication hole based on the upper gear being coupled to the upper gear coupling portion; and a lower gear that is in a back surface of the change unit body and is coupled to the lower gear coupling portion, the lower gear configured to operate an other one of the chamber opening hole and the arm channel opening hole to open an other one of the chamber communication hole and the arm channel communication hole based on the lower gear being coupled to the lower gear coupling portion.

The channel change unit further includes a change unit guider extended from the back surface of the change unit body toward the inlet hole and configured to guide the change unit body during reciprocation. One or more additional change unit guiders are in the back surface of the change unit body, and the one or more additional change unit guiders are separated a predetermined distance from a rotational center of the change unit body. The change unit guider is configured to remain inserted in the inlet hole independent of the upper gear being coupled to the upper gear coupling portion.

According to another innovative aspect of the subject matter described in this specification a dishwasher includes a tub; an upper rack and a lower rack arranged in the tub and configured to receive objects; a tower nozzle includes a tower channel having a first end fixed to the lower rack and a second end extended toward the upper rack; an injection nozzle rotatably coupled to the tower channel and configured to inject water supplied from the tower channel to the upper rack; a downward injection channel configured to expel water held in the injection nozzle toward the lower rack; and a downward injection guider configured to spray water expelled from the downward injection channel to a top portion of a lower arm; and a water supply pump configured to supply water to the tower channel.

These and other embodiments can each optionally include one or more of the following features. The injection nozzle further includes a connection pipe coupled to the tower channel and configured to rotatably support the injection nozzle against the tower channel; and an injection hole configured to supply water from the tower channel to the upper arm, and wherein the downward injection channel is in a coupling space between the connection pipe and the tower channel. The downward injection channel is in a groove provided in one of the connection pipe and the tower channel to expel water from the injection nozzle. The downward injection guider is in a lower portion of the downward injection channel along an outer circumferential surface of the tower channel and is in an annular shape.

The downward injection guider includes a guider body that includes a channel penetrating hole configured to accept the tower channel; a blade that is in a rotational center of the guider body and extending toward an edge of the guider body, the blade being configured to rotate the guider body based on water being expelled from the downward injection channel. One or more additional blades are on the guider body, and the one or more additional blades are arranged on the guider body in a spiral. The downward injection guider further includes an outlet hole that is between two blades on the guider body and configured to penetrate the guider body. The outlet hole is a predetermined length from the rotational center of the guider body to the edge of the guider body.

The downward injection guider further includes a bent groove between two blades on the guider body, the bent groove formed by bending an outer circumferential surface of the guider body toward the rotational center of the guider body. The downward injection guider further includes a surface tilted a predetermined angle from the edge of the guider body. The dishwasher further includes a lower arm that is under the lower rack and configured to supply water drawn by the water supply pump to the lower rack; and a tower connection part that is retractable from the lower arm based on water pressure inside the lower arm, the tower connection part being connected to the tower channel based on being retracted from the lower arm and being configured to supply water to the tower channel.

According to an innovative aspect of the subject matter described in this specification, a dishwasher includes a tub; a rack in the tub configured to receive objects; an injection arm includes a lower arm configured to draw water into the lower arm; a first arm channel configured to inject water to the rack, the first arm channel being in communication with a lower arm chamber via a first supply hole; and a second arm channel configured to inject water to the rack, the second arm channel being in communication with the lower arm chamber via a second supply hole and being separated from the first arm channel by a wall; a water pump configured to supply water to the lower arm chamber; and a channel change unit that is in the lower arm chamber to alternatively open the first supply hole and the second supply hole based on water pressure inside the lower arm chamber.

These and other embodiments can each optionally include one or more of the following features. The channel change unit includes a change unit body configured to reciprocate and rotate in the lower arm chamber based on the water pressure inside the lower arm chamber; a first opening hole in the change unit body and configured to open the first supply hole based on a rotational angle of the change unit body; and a second opening hole in the change unit body and configured to open the second supply hole based on the rotational angle of the change unit body. The lower arm chamber includes an inlet hole configured to draw water into the lower arm chamber; a lower gear coupling portion that covers the inlet hole; and an upper gear coupling portion that is beyond the lower gear coupling portion.

The channel change unit further includes an upper gear that is in a top surface of the change unit body and is coupled to the upper gear coupling portion, the upper gear being configured to operate one of the first opening hole and the second opening hole to open one of the first supply hole and the second supply hole based on the upper gear being coupled to the upper gear coupling portion; and a lower gear that is in a back side of the change unit body and is coupled to the lower gear coupling portion, the lower gear configured to operate an other one of the first opening hole and the second opening hole to open an other one of the first supply hole and the second supply hole based on the lower gear being coupled to the lower gear coupling portion.

DETAILED DESCRIPTION

Figure 1:
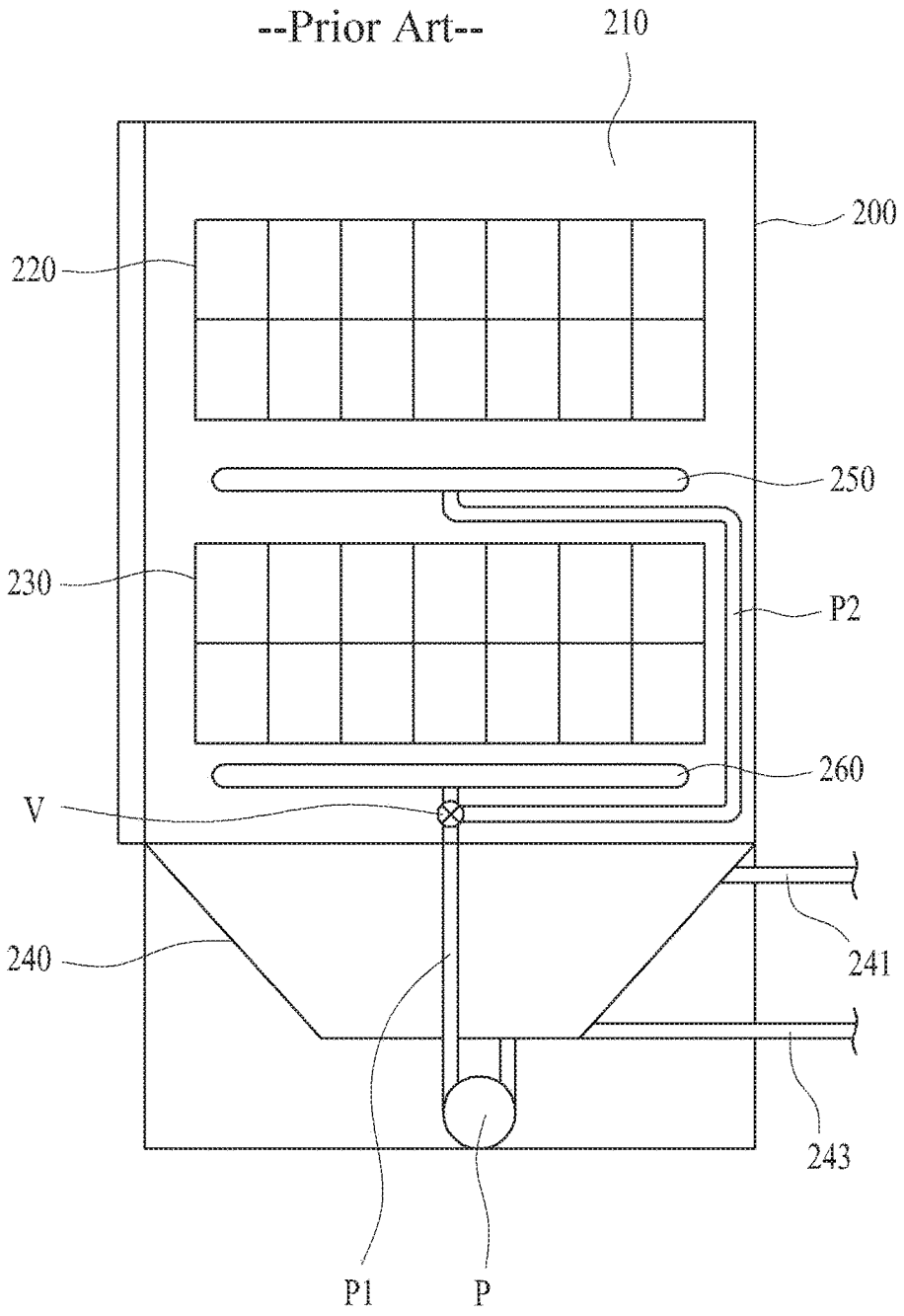
FIG. 1 is a diagram illustrating a conventional dishwasher.
Figure 2:
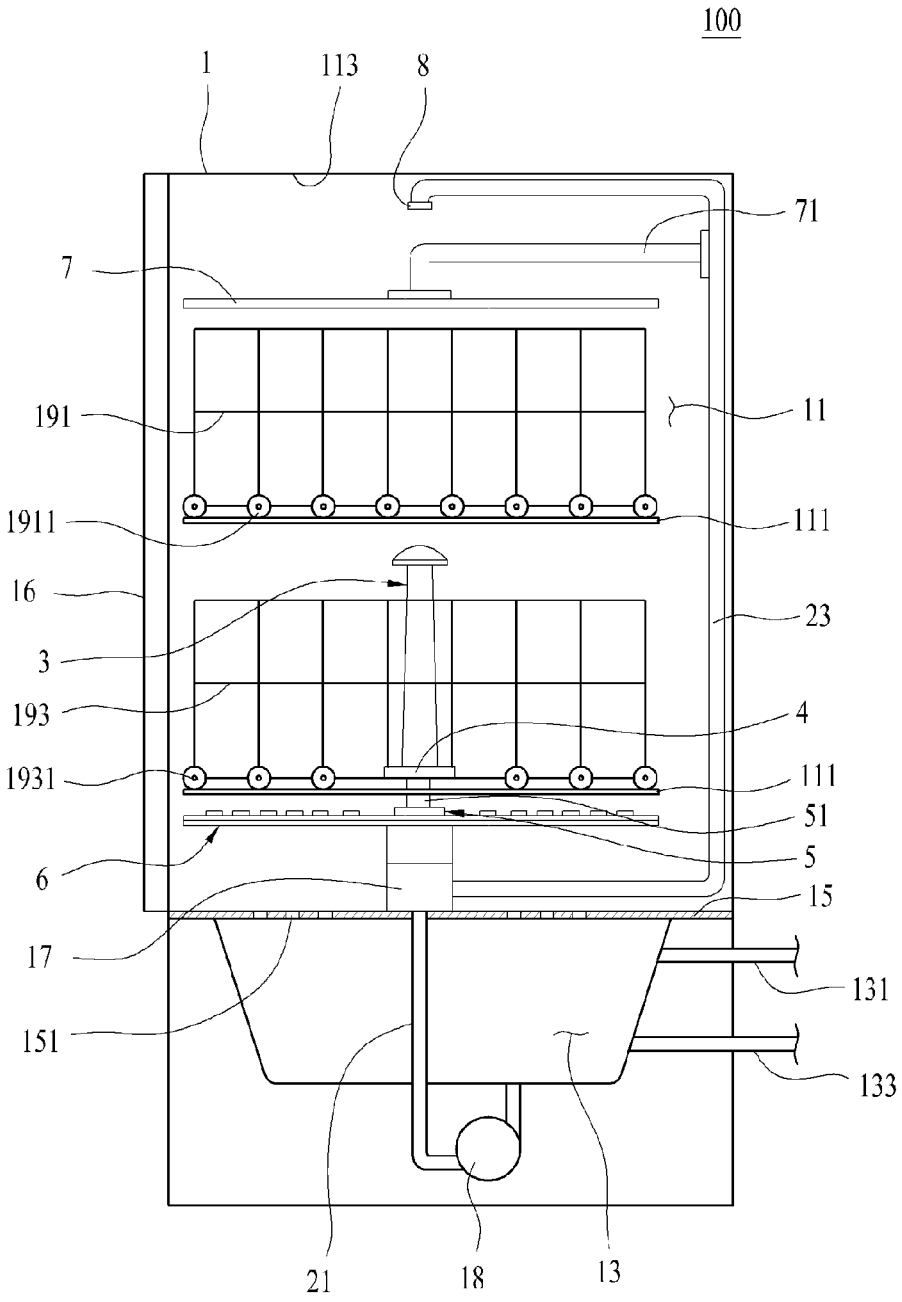
FIG. 2 is a diagram illustrating a structure of an example dishwasher.

FIG. 2 is a diagram illustrating a structure of an example dishwasher. The dishwasher 100 includes a cabinet 1 configured to define an exterior appearance thereof, a tub 11 arranged in the cabinet to provide a washing room 113, a sump 13 provided under the tub 11 to hold washing water therein, a sump cover 15 provided on the sump 13 to separate the sump 13 from the tub 11, and a door 16 coupled to the cabinet to open and close the washing room 113.

The sump 13 is connected to a sump water supply channel 131 for supplying washing water and a sump water drainage channel 133 for draining the washing water held in the sump. The sump cover 15 includes injection arms 6 and 7 and a collection hole 151 for collecting the washing water injected (ejected or sprayed) into the washing room 113 via a top nozzle 8 to the sump.

A rack may be provided in the tub 11 to place washing objects thereon and examples of such washing objects include dishes. The rack may include a first rack 191 and a second rack 193 positioned under the first rack. The first rack 191 may be referenced to as 'an upper rack' and the second rack 193 may be referenced to as 'a lower rack'.

The upper rack 191 and the lower rack 193 may be separable from the tub 11 when the door 16 opens the washing room 113. For that, a rail 111 may be provided in an inner circumferential surface of the tub toward the door 16. Wheels 1911 and 1913 supporting the racks may be provided in the upper and lower racks, respectively.

The dishwasher may include a lower arm 6 provided in the tub 11 to wash the washing objects placed on the lower rack 193, an upper arm 7 to wash the washing objects placed on the upper rack 191, and a top nozzle 8 provided in an upper top of the tub 11.

The lower arm 6 is rotatably coupled to an inner surface of the tub 11 by an arm holder 17 fixed in the sump cover 15 and the lower arm 6 is supplied the washing water stored in the sump 13 via a water supply pump 18 and a water supply channel.

The water supply channel may include a first channel 21 for connecting the water supply pump 18 and the arm holder 17 with each other and a second channel 23 for connecting the arm holder 17 and the top nozzle 8 with each other. In this instance, the upper arm 7 may be connected to the second channel 23 via a connection pipe 71.

Accordingly, the washing water discharged from the sump 13 by the water supply pump 18 is supplied to the arm holder 17 via the first channel 21. A predetermined amount of the washing water supplied to the arm holder 17 is supplied to the lower arm 6 communicating with the arm holder and the other amount of the washing water flows along the second channel 23.

A predetermined amount of the washing water drawn into the second channel 23 is supplied to the upper arm 7 via a second channel connection pipe 71 and the other amount of the washing water flows toward the top nozzle 8.

The upper arm 7 is arranged beyond the upper rack 191. The upper arm 7 may be rotatably coupled to the second channel connection pipe 71 to be rotated by a repulsive force of the washing water when the washing water is injected (ejected or sprayed).

The top nozzle 8 is arranged higher than the upper arm 7, which is an upper surface of the tub 11, and the top nozzle 8 is configured to inject (eject or spray) the washing water supplied from the second channel 23 toward the upper rack 191 and the lower rack 193.

Moreover, the dishwasher 100 may include a tower nozzle 3 fixed to the lower rack 193 and extended toward the upper rack 191, and a tower connection unit 5 provided in the lower arm 6, with a tower detachable pipe 51 (a tower coupling pipe) detachable from the tower nozzle 3 according to a pressure of water stored in the lower arm 6.

In case of the dishwasher having the tower nozzle 3 and the tower connection unit 5, the height of the dishwasher may be reduced, when the dishwasher does not include the top nozzle 8 and the upper arm 7.

Figure 3:
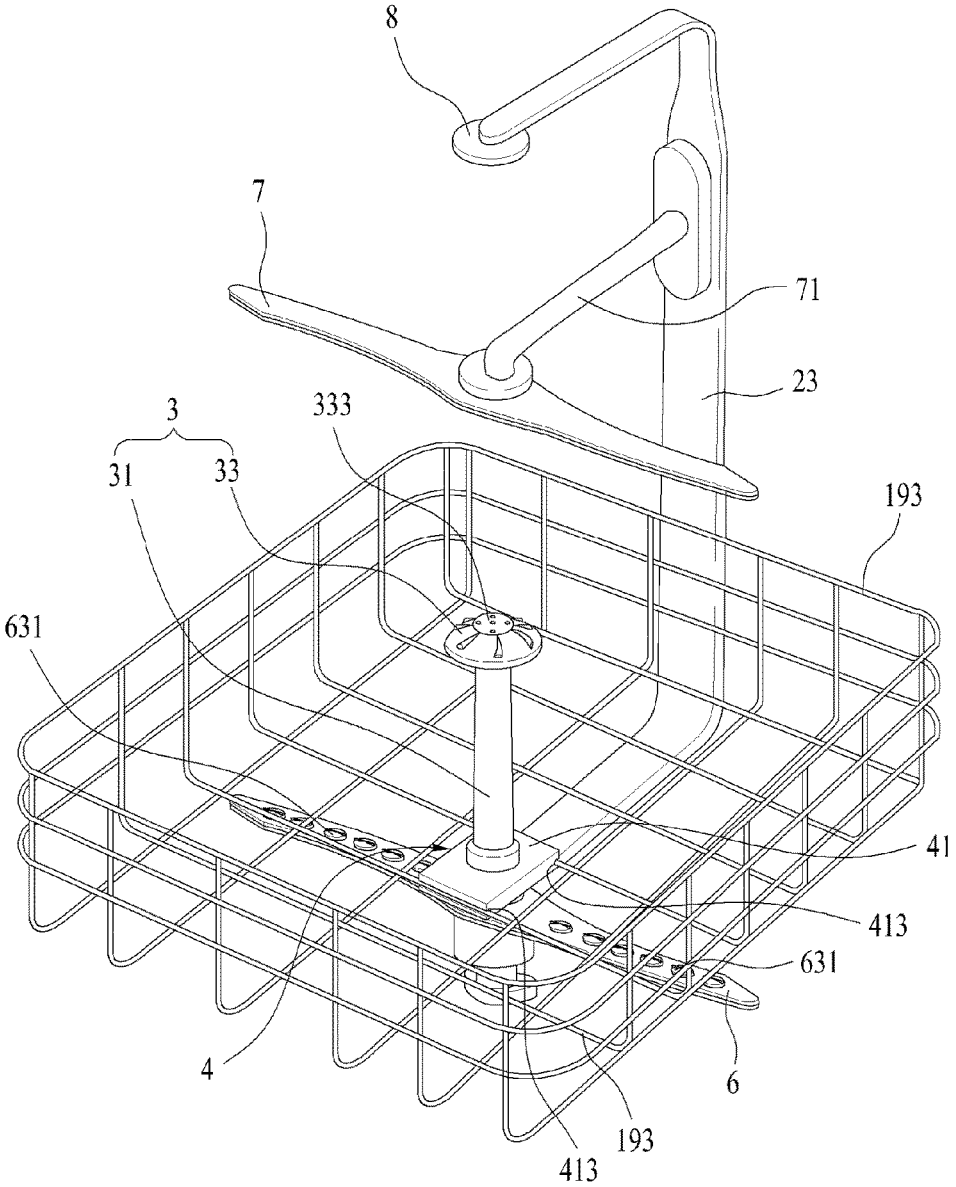
FIG. 3 is a diagram illustrating an example connection structure between an example tower nozzle and an example lower rack.
Figure 4:
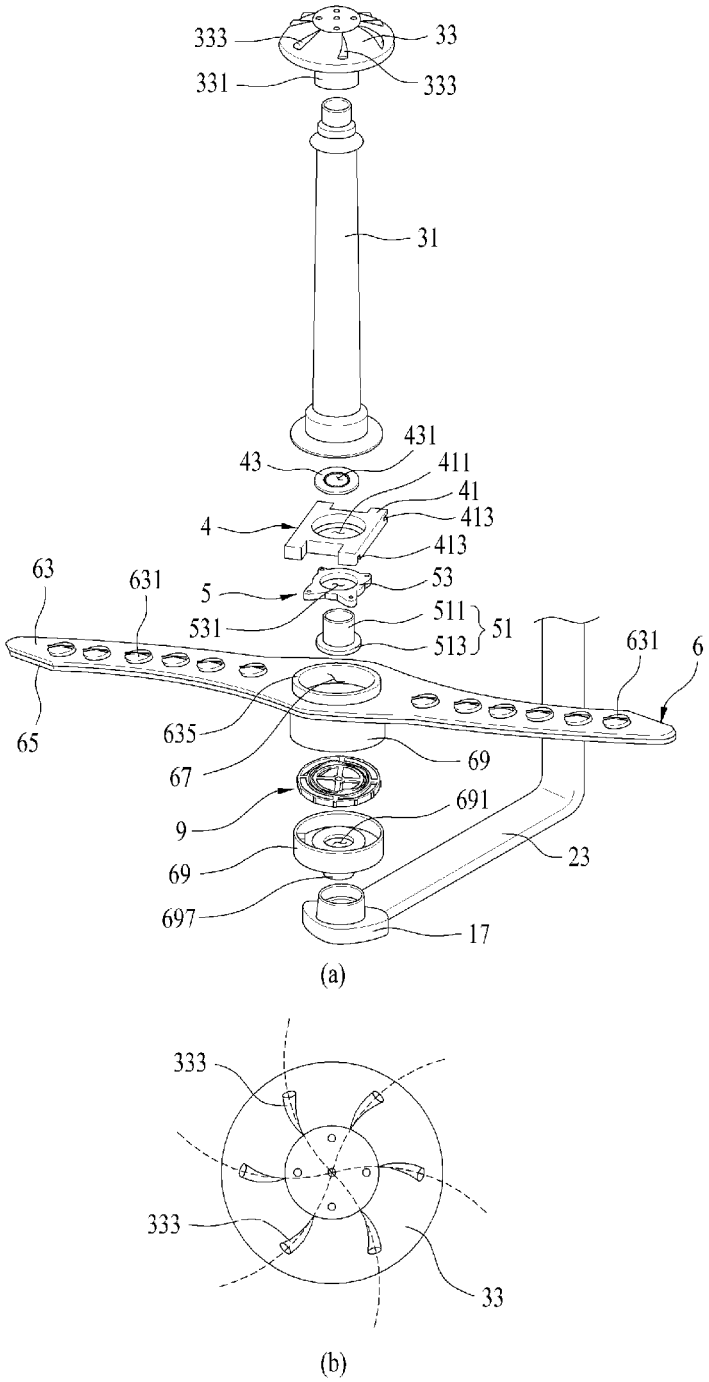
FIG. 4 is an exploded perspective diagram illustrating an example tower nozzle, an example rack fixing part, an example tower connection part, and an example lower arm.

As shown in FIGS. 3 and 4, the tower nozzle 3 is detachable to the lower rack 193 by a rack fixing part 4. The tower nozzle 3 may include a tower channel 31 coupled to the rack fixing part 4 to flow the washing water there through from the tower connection part (i.e. the tower connection unit) 5, and an injection nozzle 33 configured to inject the washing water supplied via the tower channel 31.

The tower channel 31 may be cylindrical shaped, with open top and bottom. The injection nozzle 33 is coupled to the open upper end of the tower channel and the rack fixing part 4 is coupled to the open lower end.

In addition, the tower channel 31 may have a diameter that is getting decreased from a lower portion toward an upper portion and that is because the washing water drawn via the lower end of the tower channel 31 has to flow to the open upper end, maintaining a predetermined pressure.

As shown in FIG. 4, the injection nozzle 33 may include a connection pipe 331 coupled to the upper end of the tower nozzle 3 and a plurality of injection holes 333 for exhausting the washing water drawn into the injection nozzle 33 outside via the connection pipe.

The connection pipe 331 may connect the tower channel 31 and the injection nozzle 33 with each other to rotate the injection nozzle 33. The plurality of the injection holes 333 may be configured to make the injection nozzle 33 rotate by the repulsive force of the washing water exhausted from the injection nozzle 33.

In this regard, the plurality of the injection holes 333 may be arranged in a top surface of the injection nozzle 33 spirally, to rotate the injection nozzle 33 in a clockwise or counter-clockwise direction when the washing water is expelled.

The rack fixing part 4 is fixed to the lower rack (193, see FIG. 3), to fix a rack fixing body 41 supporting the tower channel 31.

As shown in FIG. 4, the rack fixing body 41 may include a fixing body penetrating hole 411 and a rack coupling portion 413.

The rack coupling portion 413 is configured to make the rack fixing body 41 detachable from the lower rack 193. As shown in the drawing, a surface of the rack coupling portion 413 is curved concavely or projected from the rack fixing body 41 as a hook to form the rack coupling portion 413.

The fixing body penetrating hole 411 may penetrate the rack fixing body 41 and it may include a detachable pipe coupling portion where a detachable pipe body 511 of the tower connection part 5 is coupled.

A detachable pipe accommodating hole 431 is provided in the detachable pipe coupling portion 43 to insert the detachable pipe body 511 therein. When the detachable pipe body 511 is inserted in the detachable pipe accommodating hole 431, the detachable pipe body 511 is connected with the tower channel 31.

The tower connection part 5 is drawn from the lower arm 6 according to an inner pressure of a detachable pipe chamber 67 (a coupling pipe chamber). After that, the tower connection part 5 is connected to the detachable pipe accommodating hole 431. When the tower connection part 5 is connected to the detachable pipe accommodating hole 431, the washing water is supplied to the tower channel 31.

The tower connection part 5 may include a tower detachable pipe 51 detachable from the detachable pipe chamber 67 of the lower arm 6 and an arm fixing body 53 fixed to the lower arm 6 to prevent separation of the tower detachable pipe 51 from the detachable pipe chamber 67.

The tower detachable pipe 5 may include a detachable pipe body 511 that is cylindrical shaped with open upper and lower ends and a detachable pipe flange 513 provided in an outer circumferential surface of the detachable pipe body 511.

The detachable pipe coupling portion 43 provided in the rack fixing part may be formed of an elastic material.

Examples of such an elastic material include rubber and that is to prevent leakage of the washing water supplied to the tower channel 31.

In other words, when the detachable pipe body 511 is extracted from the detachable pipe chamber 67 by the inner pressure of the detachable pipe chamber 67, the detachable pipe body 511 is inserted in the detachable pipe accommodating hole 431. At this time, when the detachable pipe body 511 is formed of such an elastic material, the detachable pipe accommodating hole 431 and the detachable pipe body 511 can be close airtight, such that the washing water inside the tower channel 31 may be prevented from flowing to a space formed between the detachable pipe accommodating hole 431 and the detachable pipe body 511.

Also, when the detachable pipe coupling portion 43 is formed of an elastic material, a diameter of the detachable pipe body 511 may be larger than a diameter of the detachable pipe accommodating hole 431.

When the diameter of the detachable pipe body 511 is larger than that of the detachable pipe accommodating hole 431 in case the detachable pipe coupling portion 43 is formed of the elastic material, the washing water inside the tower channel 31 can be prevented from flowing to the space between the detachable pipe accommodating hole 431 and the detachable pipe body 511.

The arm fixing body 53 may include a penetrating hole 531 to pass the detachable pipe body 511 there through. A diameter of the penetrating hole 531 is the same as a diameter of an outer circumferential surface of the detachable pipe body 511 and smaller than a diameter of the detachable pipe flange 513. That is to prevent separation of the tower detachable pipe 51 from the lower arm 6.

The lower arm 6 may include a lower arm chamber 69 supplied the washing water, in communication with an arm holder 17, a detachable pipe chamber 67 accommodating the tower detachable pipe 51, in communication with the lower arm chamber 69, and an arm channel 61 in communication with the lower arm chamber 69.

Figure 5:
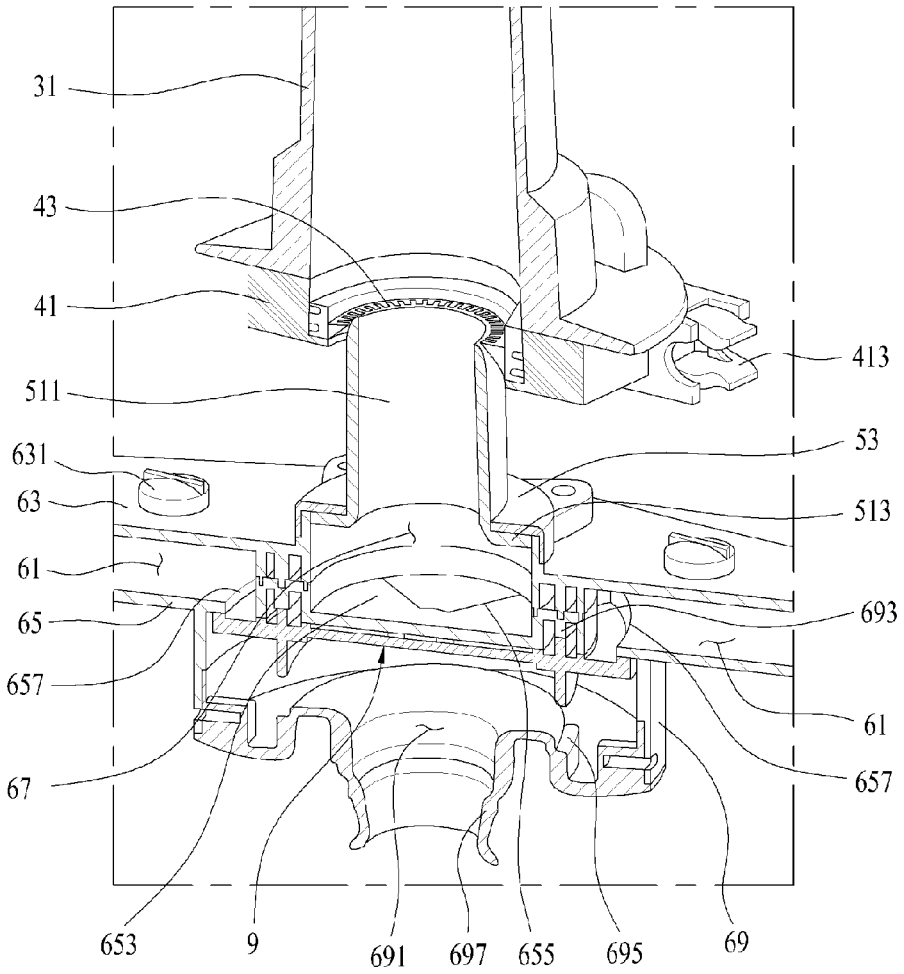
FIG. 5 is a diagram illustrating an example connection structure among an example tower nozzle, an example rack fixing part, an example tower connection part, and an example lower arm.

As shown in FIG. 5, the arm channel 61 is defined by upper and lower frames 63 and 65 and the arm channel 61 is in communication with the lower arm chamber 69 via an arm channel penetrating hole 657.

Figure 6:
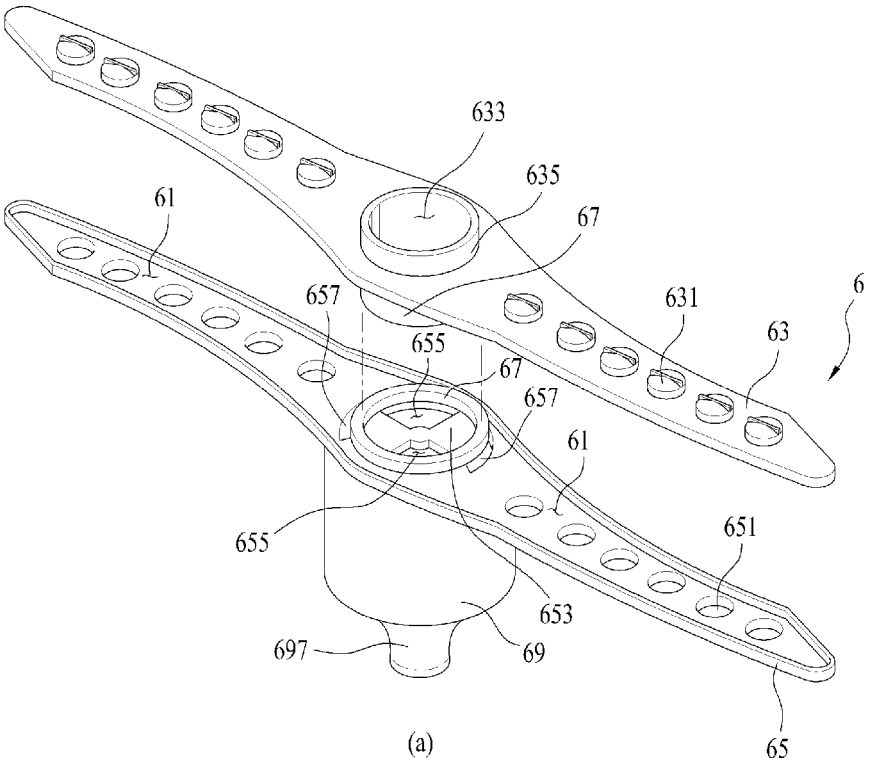
FIG. 6 is a diagram of the example lower arm.
Figure 6:
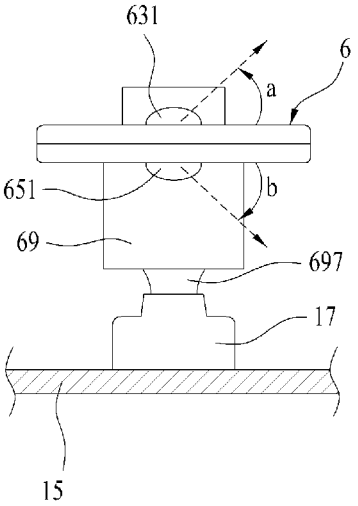

As shown in FIG. 6, the upper frame 63 may include an upper injection hole 631 configured to inject (eject or spray) the washing water flowing in the arm channel 61 toward the lower rack 193, a frame penetrating hole 633 penetrating the upper frame to make the tower detachable pipe 51 accommodated by the detachable pipe chamber 67, and a fixing body connecting portion 635 having the arm fixing body 53 connected thereto.

The lower frame 65 may include an arm channel communication hole 657 configured to connect a lower arm chamber 69 and an arm channel 61 with each other, a lower injection hole 651 configured to inject the washing water supplied to the arm channel 61 toward the sump cover 15, a chamber partition wall 653 configured to separate the lower arm chamber 69 from the detachable pipe chamber 67, and a chamber communication hole 655 provided in the chamber partition wall to connect the lower arm chamber 69 and the detachable pipe chamber 67 with each other.

The detachable pipe chamber 67 may be positioned between one arm channel communication hole 657 and another arm channel communication hole 657, and it is configured of a wall extended from one surface of the lower frame 65 toward the fixing body connecting portion 635 of the upper frame 63.

The lower arm chamber 69 is provided under the lower frame 65 to cover (surround) the arm channel communication hole 657, as shown in FIG. 5.

The lower arm chamber 69 may include an arm holder connection pipe 697 rotatably coupled to the arm holder 17, an inlet hole 691 penetrating the arm holder connection pipe to lead the washing water into the lower arm chamber 69, a lower gear coupling portion 695 provided in a bottom surface of the lower arm chamber 69, and an upper gear coupling portion 693 provided in a top surface of the lower arm chamber 69.

The lower gear coupling portion 695 may be coupled to a lower gear 99 provided in a channel change unit 9 to rotate the channel change unit 9 a predetermined angle. The lower gear coupling portion 695 may be provided along an outer circumferential surface of the inlet hole 691.

The upper gear coupling portion 693 may be coupled to an upper gear 97 provided in the channel change unit 9 to rotate the channel change unit 9 a predetermined angle.

The upper gear coupling portion 693 may be provided in a top surface of the lower arm chamber 69 and it may be arranged in a space between the detachable pipe chamber 67 and the arm channel communication hole 657. In other words, the upper gear coupling portion 693 may be provided in the space formed between the detachable pipe chamber 67 and the arm channel communication hole 657 along the outer circumferential surface of the detachable pipe chamber 67.

The upper injection hole 631 provided in the upper frame may be configured to inject the washing water, by being tilted a predetermined angle (a) with respect to a surface of the upper frame 63, such that the lower arm 6 may be rotated on the arm holder connection pipe 697 as its axis by the repulsive force of the washing water exhausted from the arm channel 61 (see, FIG. 6 (*b*)).

In addition, the lower injection hole 651 provided in the lower frame may be be configured to inject the washing water, by being tilted a predetermined angle (b) with respect to a surface of the lower frame 65, such that the lower arm 6 may be rotated on the arm holder connection pipe 697 as its axis by the repulsive force of the washing machine exhausted from the arm channel 61 (see FIG. 6 (*b*)).

The lower injection hole 651 injects the washing water toward the sump cover 15. When the lower arm 6 is rotated, the collecting hole 151 of the sump cover 15 may not be plugged with foreign substances.

The channel change unit 9 may be provided in the lower arm chamber 69 and it may be configured to alternately open a chamber communication hole 655 and an arm channel communication hole 657 based on the pressure inside the lower arm chamber 69.

Figure 7:
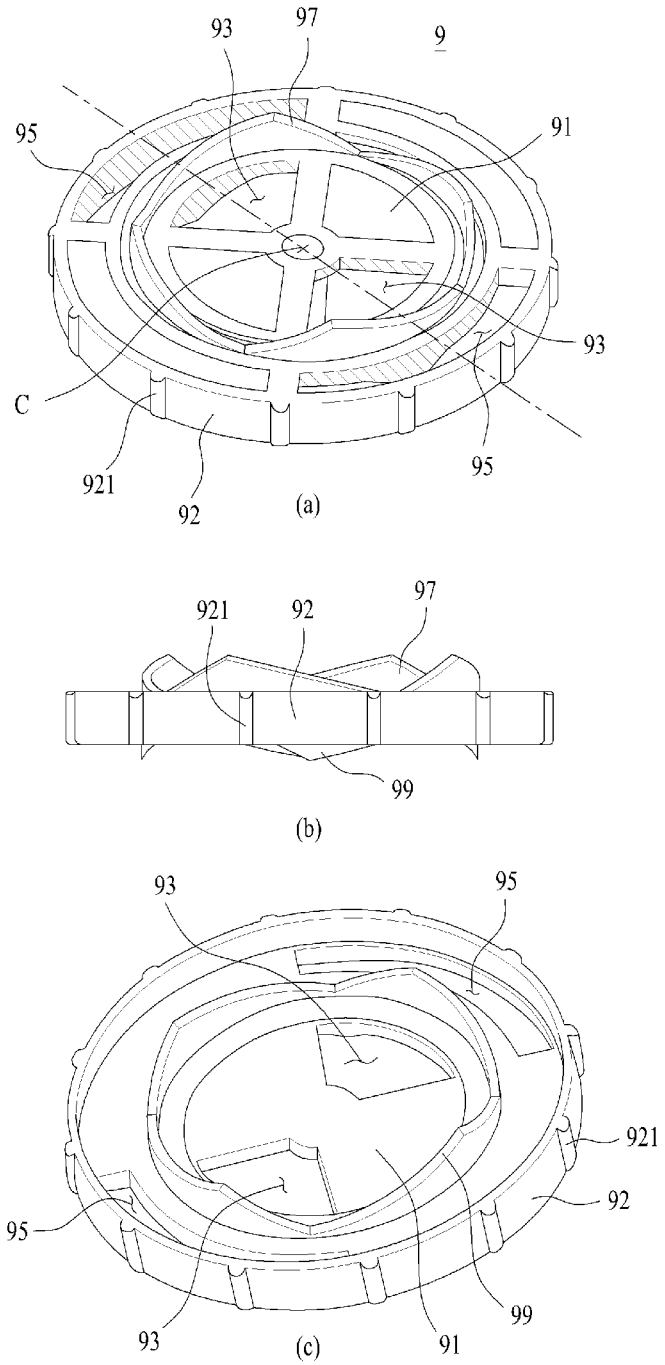
FIG. 7 is a perspective diagram of an example channel change unit.

As shown in FIG. 7, the channel change unit 9 may include a change unit body 91 positioned in the lower arm chamber 69, a chamber opening hole 93 (hereinafter, a first opening hole) penetrating the change unit body 91 to open the chamber communication hole 655, and an arm channel opening hole 95 (hereinafter, a second opening hole) penetrating the change unit body 91 to open the arm channel communication hole 657.

The change unit body 91 may be configured to reciprocate between a bottom surface and an upper surface in the lower arm chamber 69 based on the water pressure inside the lower arm chamber 69 and it may be formed in a disk shape.

In other words, when the water pressure inside the lower arm chamber 69 is high (the washing water is supplied to the lower arm chamber), the change unit body 91 moves from the bottom surface toward the top surface of the lower arm chamber 69. When the water pressure inside the lower arm chamber 69 is low (the washing water is not supplied to the lower arm chamber), the change unit body 91 moves from the top surface to the bottom surface of the lower arm chamber.

Meanwhile, a flange 92 may be further provided in an outer circumferential surface of the change unit body 91 to guide the reciprocation of the change unit body 91.

The flange 92 is provided to contact an inner circumferential surface of the lower arm chamber 69 and it guides the reciprocation of the change unit body 91, to help the change unit body 91 maintain level during the reciprocation.

In other words, there is a predetermined tolerance between the outer circumferential surface of the change unit body 91 and the inner circumferential surface of the lower arm chamber 69. If an object, such as the flange 92, for guiding the motion of the change unit body is not provided, the change unit body 91 might lose level in the lower arm chamber 69.

If the change unit body 91 loses level in the lower arm chamber 69, the outer circumferential surface of the change unit body 91 might contact with the inner circumferential surface of the lower arm chamber 69 and it may not perform the upward and downward motion even when the washing water is supplied to the lower arm chamber 69.

A plurality of projections 921 (hereinafter, flange projections) or a plurality of grooves (not shown) may be provided in the flange 92 to prevent foreign substances from being plugged between the flange 92 and the lower arm chamber 69.

Moreover, an upper gear 97 may be provided in a top surface of the change unit body 91 to be coupled to the upper gear coupling portion 693 provided in the lower arm chamber 69 and a lower gear 99 may be provided in a bottom surface of the change unit body 91 to be coupled to the lower gear coupling portion 695.

The upper gear 97 provided in the top surface of the change unit body 91 is coupled to the upper gear coupling portion 693 to rotate the change unit body 91 in a clockwise direction (or a counter-clockwise direction) and the lower gear 99 provided in the bottom surface of the change unit body 91 is coupled to the lower gear coupling portion 695 to rotate the change unit body 91 in a clockwise direction (or a counter-clockwise direction).

The rotational direction of the change unit body 91 when the lower gear 99 and the lower gear coupling portion 695 are coupled to each other may be the same direction as that of the change unit body 91 when the upper gear 97 and the upper gear coupling portion 693 are coupled to each other.

The upper gear 97 and the upper gear coupling portion 693 may be formed in a predetermined shape to rotate the change unit body 91 a predetermined angle after coupled to each other. The lower gear 99 and the lower gear coupling portion 693 may be formed in a predetermined shape to rotate the change unit body 91 a predetermined angle after coupled to each other.

When the upper gear 97 and the lower gear 99 are distant at about 90 degrees as shown in FIG. 6, the chamber communication hole 655 and the arm channel communication hole 657 provided in the lower arm 6 may be arranged on a line passing a rotational center (C) of the change unit body 91.

In this instance, the upper gear coupling portion 693 and the upper gear 97 may be provided in a predetermined shape for the change unit body 91 rotated about 45 degrees in the clockwise direction (or the counter-clockwise direction) to open the chamber communication hole 655 or the arm channel communication hole 657, when they are coupled to each other.

The lower gear coupling portion 695 and the lower gear 99 may be provided in a predetermined shape for the change unit body 91 to be rotated about 45 degrees in the clockwise direction (or the counter-clockwise direction), when they are coupled to each other.

In some implementations, the chamber opening hole 93 and the arm channel opening hole 95 may be separated by about 90 degrees with respect to the rotational center (C) of the change unit body 91. The chamber communication hole 655 and the arm channel communication hole 657 may be arranged on a straight line.

Figure 8:
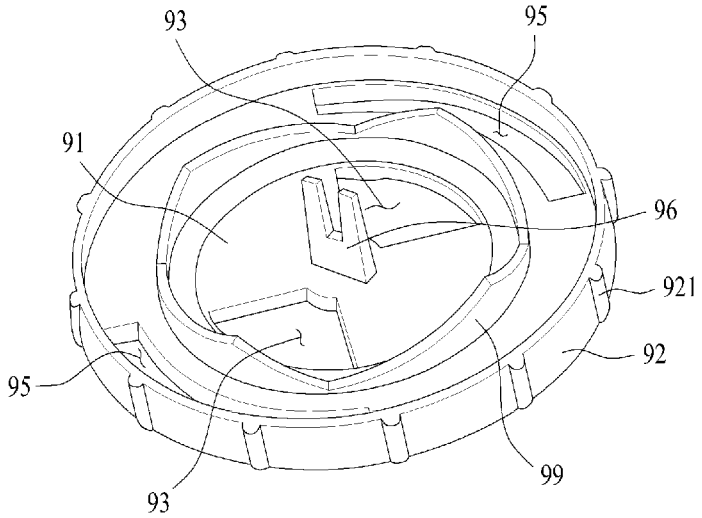
FIGS. 8 and 9 are diagrams illustrating an example channel change unit.
Figure 8:
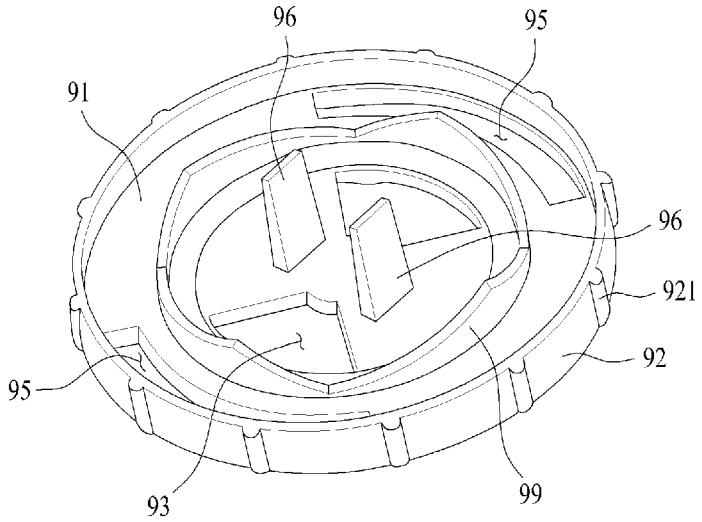

FIG. 8 is a diagram illustrating an example channel change unit. The channel change unit 9 may further include a change unit guider 96 configured to balance a gravity center of the change unit body 91 and provided in a bottom surface of the change unit body 91 and to guide reciprocation of the change unit body 91 in a lower arm chamber 69.

As shown in FIG. 8 (*a*), the change unit guider 96 is extended from a center of the change unit body 91 toward the inlet hole 691. The change unit guider 96 may have a predetermined length long enough for one end to be inserted in the inlet hole 691 even in case the upper gear 97 is coupled to the upper gear coupling portion 693.

As shown in FIG. 8 (*b*), at least two change unit guiders 96 may be provided under the change unit body 91.

In this instance, the change unit guiders 96 may be spaced apart a predetermined distance from each other with respect to the center of the change unit body 91.

Figure 9:
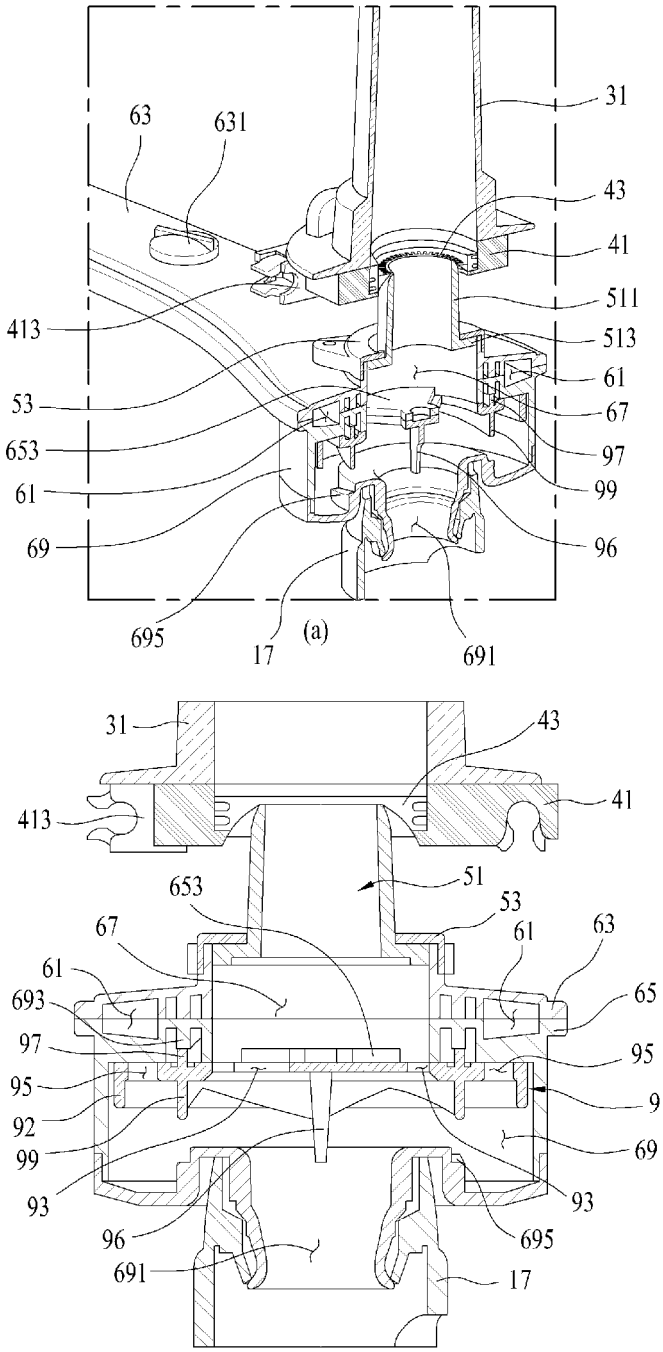

As shown in FIG. 9, each of the change unit guiders 96 may be extended from the bottom surface of the change unit body 91 toward the inlet hole 691 and the change unit guider 96 may be long enough to maintain the inserted state in the inlet hole 691 after the upper gear 97 is coupled to the upper gear coupling portion 693.

Moreover, the distance between one change unit guider 96 and the other may be less than a diameter of the inlet hole 691.

Accordingly, when the change unit body 91 reciprocates in the lower arm chamber 69 based on the water pressure inside the lower arm chamber 69, the change unit guider 96 contacts with an inner circumferential surface of the inlet hole 691 to help the change unit body 91 balance level.

In addition, a gravity center of the change unit body 91 is located in the position of the change unit guider 96 by the change unit guider 96. The change unit guider 96 may be effective in the change unit body 91 maintaining level in the lower arm chamber 69.

Figure 10:
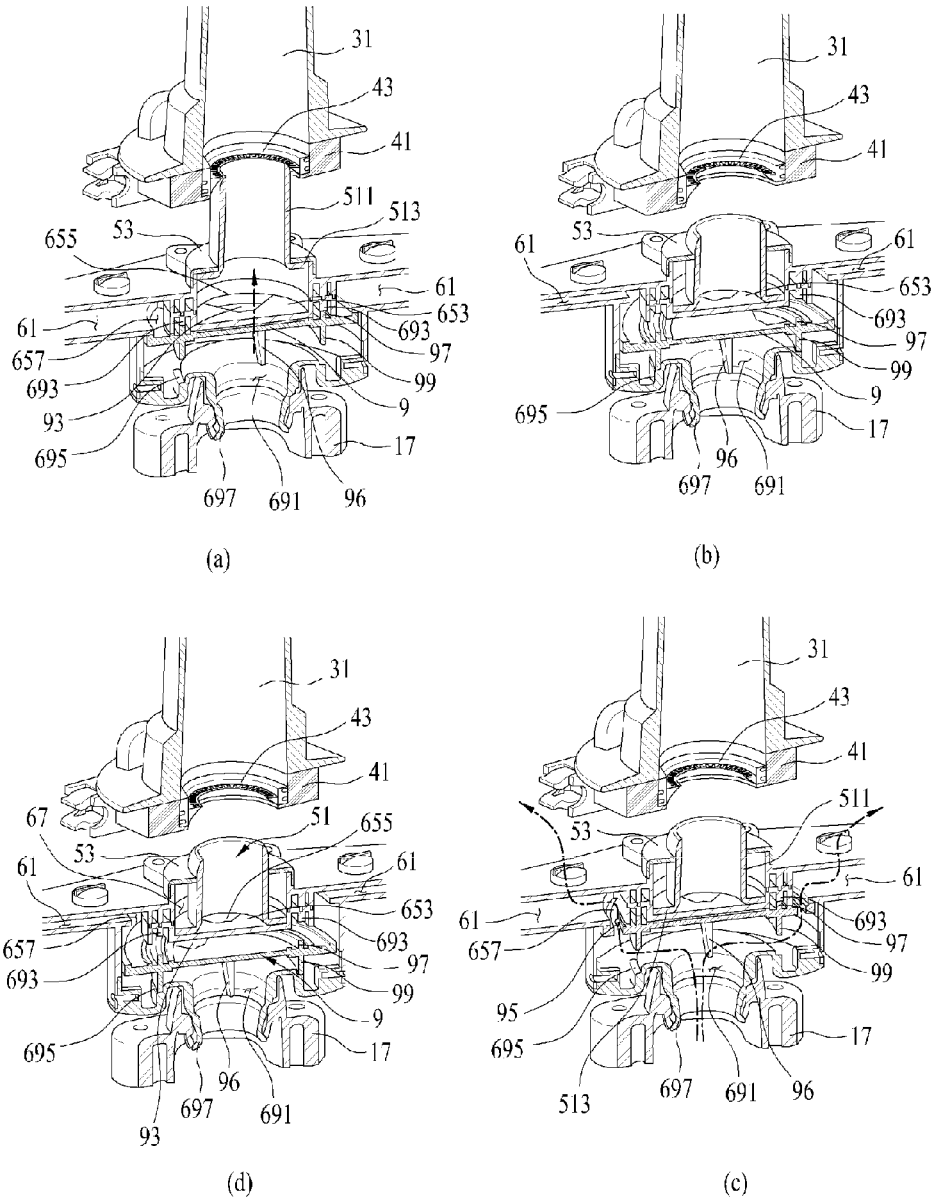
FIG. 10 is a diagram illustrating motion of an example channel change unit.

Referring to FIG. 10, the motion of the channel change unit 9 will be described as follows.

Unless the washing water is supplied to the lower arm chamber 69 after the water supply pump 18 is rested, the channel change unit 9 is in contact with the bottom surface of the lower arm chamber 69 (see FIG. 10 (*d*)).

In this instance, the tower detachable pipe 51 keeps a state of sitting in the detachable pipe chamber 67 and the detachable pipe body 511 is not connected to the tower channel 31.

When the washing water is supplied to the arm holder 17 via the first channel 21 by the operation of the water supply pump 18, the upper arm 7 and the top nozzle 8 are supplied the washing water via the second channel 23 and the lower arm chamber 69 is supplied the washing water via the arm holder 17.

When the washing water is supplied to the lower arm chamber, the channel change unit 9 is moving toward the top surface of the lower arm chamber 69 and the upper gear 97 is coupled to the upper gear coupling portion 693 (see FIG. 10 (*a*)).

At this time, the motion of the channel change unit 9 is guided by the change unit guider 96 inserted in the inlet hole 691 and the level of the change unit body 91 may not be lost in the lower arm chamber 69.

When the upper gear 97 is coupled to the upper gear coupling portion 693, the channel change unit 9 is rotated about 45 degrees in the clockwise direction (or the counter-clockwise direction) in the lower arm chamber 69, such that the chamber opening hole 93 may open the chamber communication hole 655.

In this instance, the arm channel communication hole 657 maintains a state of being closed by the change unit body 91 and the washing water is not supplied to the arm channel 61.

When the chamber communication hole is open by the chamber opening hole 93, the washing water held in the lower arm chamber 69 is drawn into the detachable pipe chamber 67. When the washing water is supplied to the detachable pipe chamber 67, the tower detachable pipe 51 is moving upward in the detachable pipe chamber 67 by the water pressure.

The tower detachable pipe 51 is moving upward in the detachable pipe chamber 67 and the detachable pipe body 511 is inserted in the detachable pipe accommodating hole 431 of the rack fixing part 4, such that the washing water held in the detachable pipe chamber 67 may be supplied to the tower channel 31.

When the water supply pump 18 temporarily stops operating, the washing water is not supplied to the lower arm chamber 69 and the channel change unit 9 is moving toward the bottom surface of the lower arm chamber 69.

The motion of the channel change unit 9 is guided by the change unit guide 96 inserted in the inlet hole 691, such that the channel change unit body 91 may not lose level in the lower arm chamber 69.

When the channel change unit 9 is moving toward the bottom surface of the lower arm chamber 69, the lower gear 99 is coupled to the lower gear coupling portion 695 and the channel change unit 9 is rotated about 45 degrees in the clockwise (or counter-clockwise) direction.

Accordingly, the center of the chamber opening hole 93 and the center of the chamber communication hole 655 are distant from each other at about 45 degrees. Also, the center of the arm channel opening hole 95 and the arm channel communication hole 657 are distant from each other at about 45 degrees.

In addition, the detachable pipe body 511 is moving toward the detachable pipe chamber 67 after separated from the detachable pipe coupling portion 43 and then the detachable pipe body 511 is separated from the tower channel 31.

After that, the washing water is re-supplied to the lower arm chamber 69 by the water supply pump 18 and the channel change unit 9 is moving toward the top surface of the lower arm chamber 69, to couple the upper gear 97 to the upper gear coupling portion 693 (see FIG. 10 (*c*)).

When the upper gear 97 is coupled to the upper gear coupling portion 693, the channel change unit 9 is rotated about 45 degrees in the clockwise direction (or the counter-clockwise direction) and the arm channel communication hole 657 is open by the arm channel opening hole 95.

In this instance, the chamber communication hole 655 keeps the closed state by the change unit body 91 and then the washing water is not supplied to the detachable pipe chamber 67.

When the arm channel communication hole 657 is open by the arm channel opening hole 95, the washing water held in the lower arm chamber 69 is flowing into the arm channel 61.

The washing water drawn into the arm channel 61 is injected toward the lower rack 193 and the sump cover 15 via the upper injection hole 631 and the lower injection hole 651, respectively. In this process, the lower arm 6 is rotated on the arm holder connection pipe 697 as its axis.

After that, the water supply pump 18 temporarily stops operating and the washing water is not supplied to the lower arm chamber 69, such that the channel change unit 9 may be moving toward the bottom surface of the lower arm chamber 69 (see FIG. 10 (*d*)).

When the channel change unit 9 is moving toward the bottom surface of the lower arm chamber 69, the lower gear 99 is coupled to the lower gear coupling portion 695 and the channel change unit 9 is rotated about 45 degrees in the clockwise direction (or the counter-clockwise direction).

Accordingly, the center of the chamber opening hole 93 is spaced apart about 45 degrees from the center of the chamber communication hole 65 and also the center of the arm channel opening hole 95 is spaced apart about 45 degrees from the center of the arm channel communication hole 657.

As mentioned in reference to FIG. 4, the tower nozzle 3 provided in the dishwasher includes a tower channel 31 and an injection nozzle 33 rotatably coupled to the tower channel 31. The injection nozzle 33 is rotated with respect to the tower channel 31 by the repulsive force of the washing water injected (ejected or sprayed) from the injection hole 333.

A predetermined tolerance has to be formed between the tower channel 31 and the connection pipe 331 to rotatably couple the injection nozzle 33 to the tower channel 31. The tolerance between the tower channel 31 and the connection pipe 331 may make the washing water held in the injection nozzle 33 injected outside the injection nozzle 33.

The washing efficiency can be enhanced by supplying the washing water exhausted from the space between the connection pipe 331 and the tower channel 31. The tower nozzle 3 can inject the washing water to the upper rack 191 and to the lower rack 194.

In other words, the injection nozzle 33 is rotatably coupled to the tower channel 31 via the connection pipe 331. Accordingly, the tolerance formed between the connection pipe 331 and the tower channel 31 may not be excluded and may be used to enhance the washing efficiency.

Figure 11:
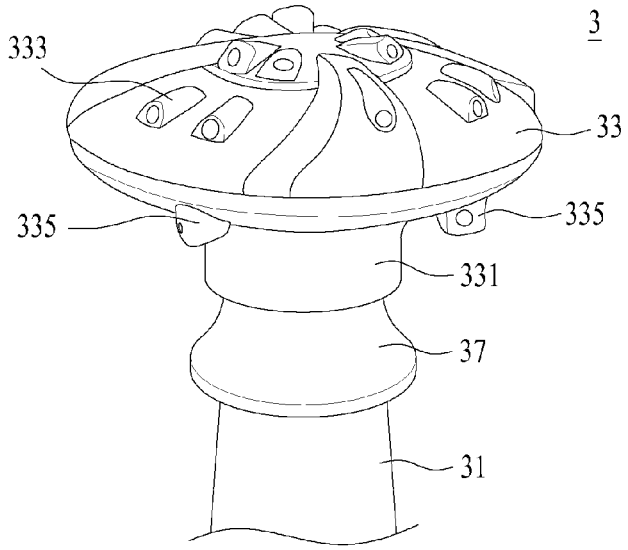
FIGS. 11 and 12 are diagrams of an example tower nozzle.
Figure 11:
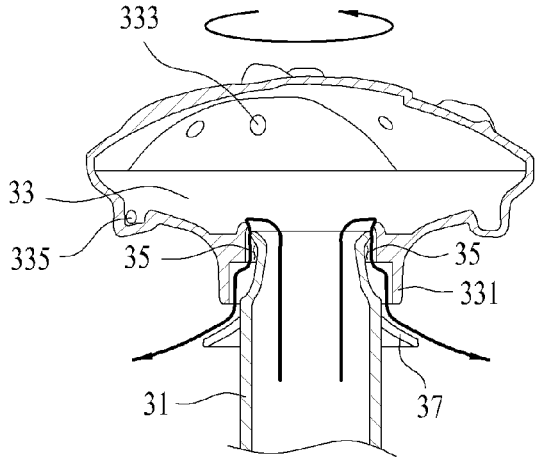

Referring to FIG. 11, the injection nozzle 33 provided in the tower nozzle 3 is rotatably coupled to the tower channel 31 via the connection pipe 331. The washing water supplied to the tower channel 31 via the plurality of the injection holes 33 is injected to the upper rack 191.

A second injection hole 335 may be further provided in the injection nozzle 33, rather than the injection holes spirally arranged in the top surface of the injection nozzle 33. The second injection hole 335 may be provided in a bottom surface of the injection nozzle 33.

In this instance, the second injection hole 335 may be configured to inject the washing water in a direction adjacent to a rotational locus of the injection nozzle 33.

Moreover, the tower nozzle 3 may further include a downward injection channel 35 provided between the connection pipe 331 and the tower channel 31 to exhaust (eject or spray) the washing water downward to the injection nozzle 33 and a downward injection guider 37 provided in the tower channel 31 to scatter the washing water exhausted from the downward injection channel 35 to the lower rack 193 uniformly.

The connection pipe 331 is rotatably coupled to the tower channel 31 and the downward injection channel 35 can be provided by the tolerance formed between the connection pipe 331 and the tower channel 31.

Here, the downward injection channel 35 may be provided in the space between the connection pipe 331 and the tower channel 31 as an auxiliary channel, so as to supply a predetermined amount of the washing water to the lower rack 193.

In other words, the downward injection channel 35 may be an auxiliary channel (a penetrating hole or a bent groove) provided in the connection pipe 331 or the tower channel 31, or it may be defined by the tolerance formed between the connection pipe 331 and the tower channel 31.

When the downward injection channel 35 is provided in the tower nozzle 3, the washing water can be supplied to the lower rack 193 and the washing efficiency can be enhanced.

The downward injection guide 37 may be provided along an outer circumferential surface of the tower channel 31 in an annular shape, with a predetermined slope to make the washing water exhausted to the downward injection channel uniformly supplied to the lower rack 193.

In other words, the downward injection guider 37 may be tilted a predetermined angle from the outer circumferential surface of the tower channel 31 toward the top of the lower rack 193 with respect to a surface parallel to the top surface of the lower rack 193.

Accordingly, a predetermined amount of the washing water supplied to the injection nozzle 33 via the tower channel 31 is exhausted to the upper rack 191 via the injection hole 333 and the second injection hole 335. The other amount of the washing water is exhausted from the injection nozzle 33 via the downward injection channel 35.

The washing water exhausted from the injection nozzle 33 via the downward injection channel 35 is scattered to an overall top area of the lower rack 193 by the downward injection guider 37, such that the washing water may be uniformly supplied to the washing objects placed on the lower rack 193.

Figure 12:
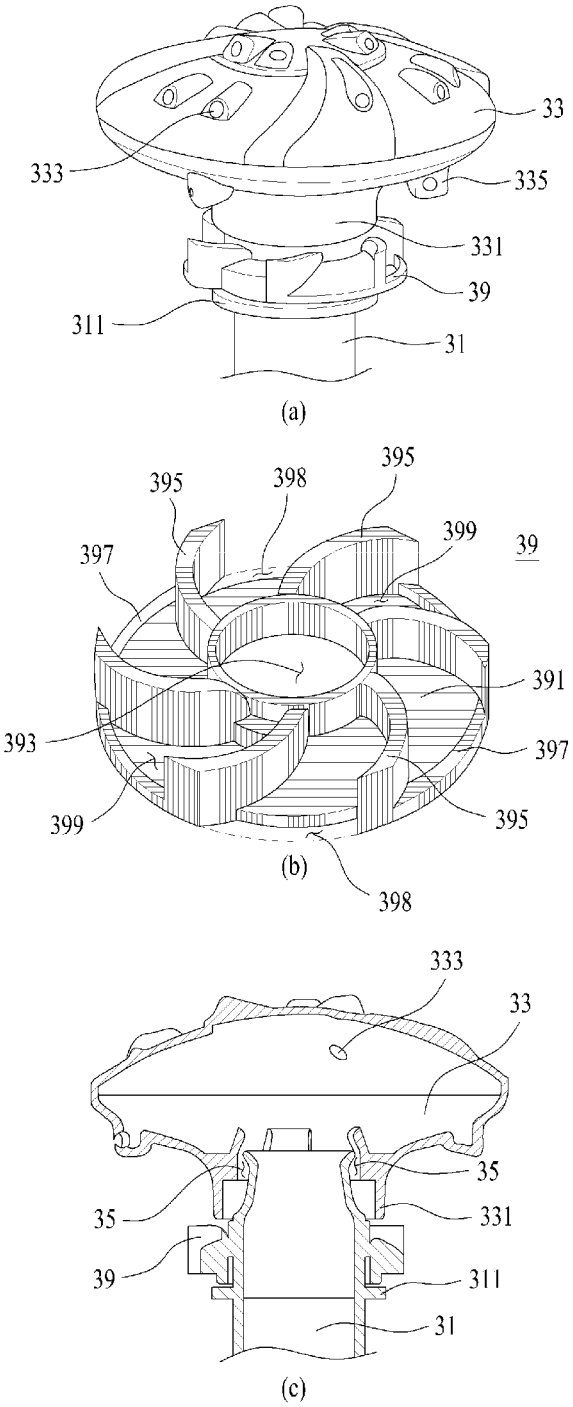

FIG. 12 is a diagram illustrating an example tower nozzle 3. In FIG. 12, a downward injection guider 39 may be provided in an impeller shape.

The downward injection guider 39 may include a guider body 391 formed in disk shape, a channel penetrating hole 393 penetrating the guider body 391, and a blade 395 provided in the guider body 391 in a spiral shape.

The tower channel 31 of the tower nozzle 3 is inserted in the channel penetrating hole 393. In this instance, a supporting portion 311 may be further provided in the outer circumferential surface of the tower channel 31 to support a bottom surface of the guider body 391.

Accordingly, the washing water exhausted outside the injection nozzle 33 via the downward injection channel 35 collides with the blade 395 arranged spirally. When the washing water is exhausted outside the injection nozzle 33 via the downward injection channel 35, the guider body 391 may rotate along the outer circumferential surface of the tower channel 31.

Once the guider body 391 rotates, the washing water exhausted from the injection nozzle 33 via the downward injection channel 35 can be supplied a centrifugal force and scattered farther.

When the downward injection guider 39 includes structure mentioned above, the washing water may be scattered farther from the tower channel 31.

The downward injection guider 39 may further include at least one of an outlet hole 399, a tilted surface 397 and a bent groove 398. The outlet hole 399 may penetrate the guider body 391 and the tilted surface is provided in an edge area of the guider body 391. The bent groove 398 may be provided in an edge area of the guider body 391.

The outlet hole 399 is a hole provided between one blade 395 and the other blade 395 and it supplies the washing water to the area close to the tower channel 31.

In other words, the outlet hole 399 penetrates the guider body 391, with a predetermined length from a rotational center of the guider body 391 (an outer circumferential surface of the channel penetrating hole) toward the edge area of the guider body 391, such that the washing water exhausted from the downward injection channel may be supplied to the area close to the tower channel 31 via the outlet hole 399.

The tilted surface 397 is located in the edge area of the guider body 391 and tilted a predetermined angle toward the top of the guider body 391. When the tilted surface 397 is provided, the washing water can be supplied to the farthest area from the tower channel 31.

In some implementations, the tilted surface 397 may be tilted toward the bottom of the guider body 391. One tilted surface 397 may be tilted toward the top of the guider body 391 and another tilted surface may be tilted toward the bottom of the guider body 391.

The bent groove 398 may be formed by an edge of the guider body 391 bent concavely toward the rotational center of the guider body 391, such that the downward injection guider 39 may supply the washing water to an area located between the area where the washing water is supplied by the outlet hole 399 and the area where the washing water is supplied by the tilted surface 397.

The tower nozzle 3 shown in FIGS. 11 and 12 may be applied to a dishwasher having the tower channel 31 connected to the first channel 21.

Figure 13:
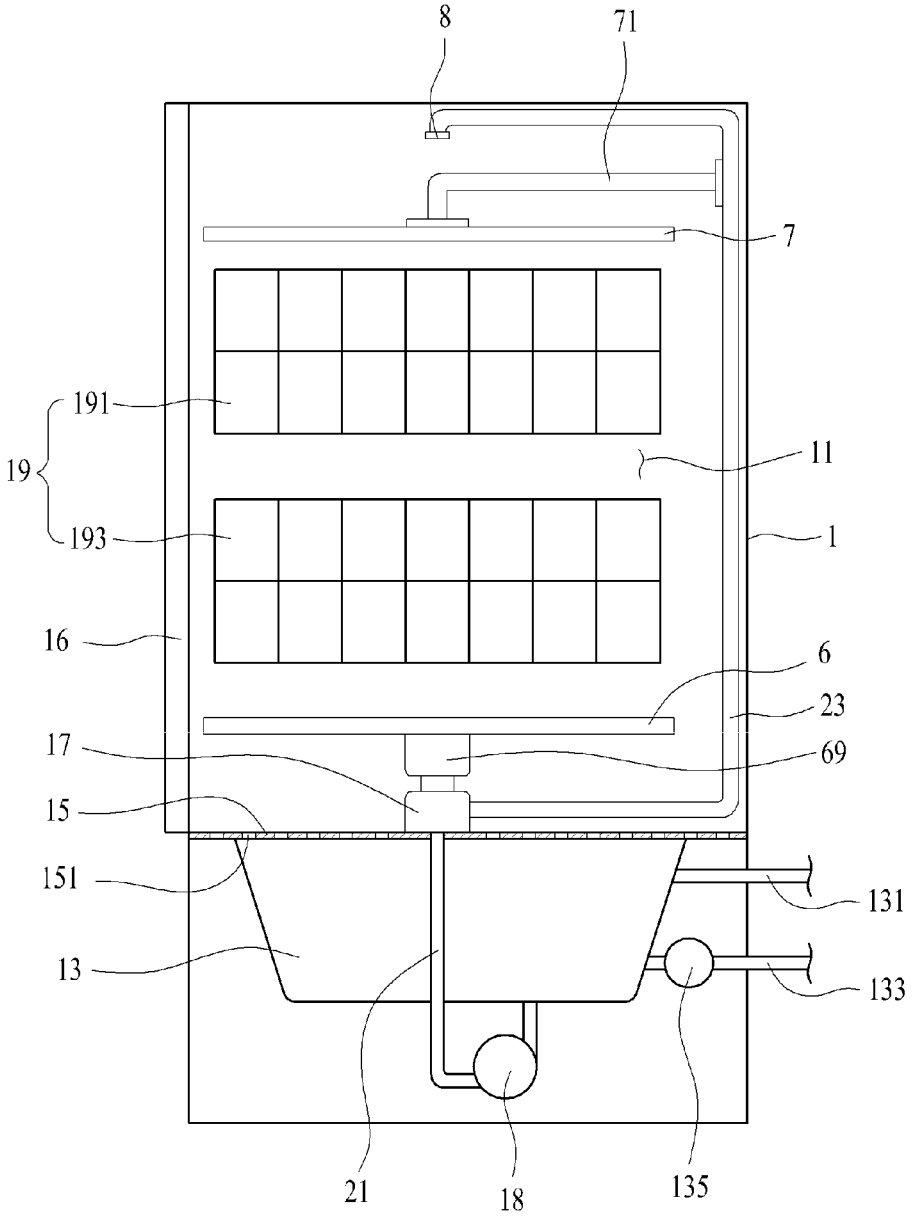
FIG. 13 is a diagram illustrating an example dishwasher.

FIG. 13 is a diagram of an example dishwasher. In FIG. 13, the dishwasher includes a plurality of channels provided in a lower arm 6. The plurality of the channels provided in the lower arm may be alternately open by the channel change unit 9 mentioned above.

The dishwasher may include a cabinet 1 having a tub 11 defining a washing room, a rack 19 provided in the tub to accommodate washing objects, and an injection arm for injecting washing water to the rack.

The rack 19 may consist of an upper rack 191 and a lower rack 193 arranged under the upper rack 191. The injection arm may consist of a lower arm 6 configured to inject (eject or spray) the washing water to the lower rack 193 and an upper arm 7 configured to inject the washing water to the upper rack 191.

The lower arm 6 is rotatably coupled to an arm holder 17 fixed to a sump cover 15 and the arm holder 17 is supplied the washing water stored in the sump 13 via a first channel 21 and a water supply pump 18.

The sump 13 is supplied the washing water via a sump water supply channel 131 and the supplied washing water is exhausted via a sump drainage channel 133. A sump pump 135 may be provided in the sump drainage channel 133.

A second channel 23 is connected to the arm holder 17 and the second channel 23 is configured not only to supply the washing water to a top nozzle 8 but also to the upper arm 7 via a second channel connection pipe 71.

Two channels are provided in the lower arm 6 may be provided in the dishwasher and the channels may be alternately open by a channel change unit 9.

Figure 14:
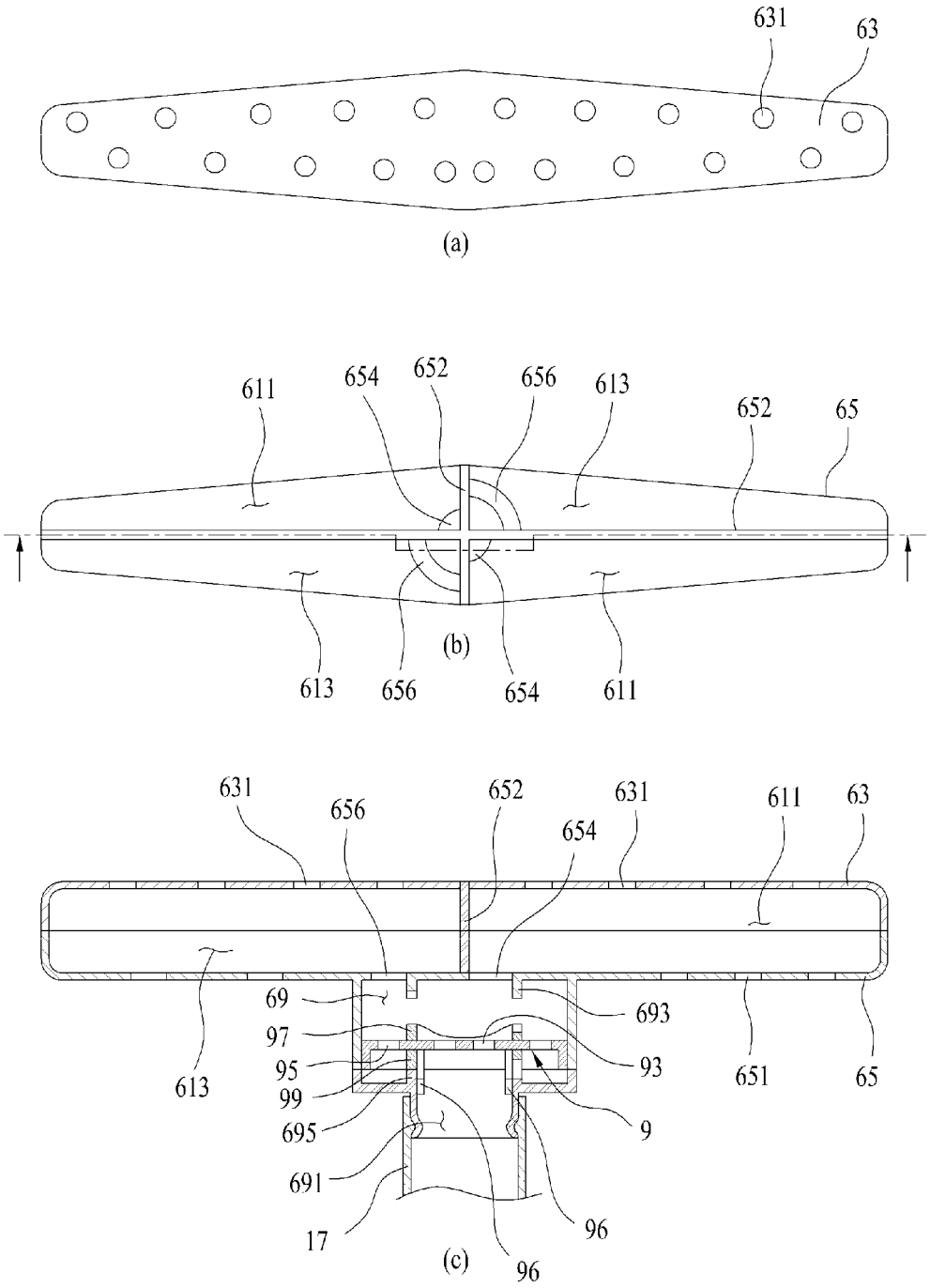
FIG. 14 is an example lower arm and an example channel change unit.

In FIG. 14, the lower arm 6 includes a lower arm chamber 69 supplied the washing water from the arm holder 17 and upper and lower frames 63 and 65 forming a first arm channel 611 and a second arm channel 613 that communicate with the lower arm chamber 69, respectively.

An upper injection hole 631 is provided in the upper frame 63 to inject the washing water toward the lower rack 193.

The lower frame 65 includes a channel partition wall 652 configured to separate the first arm channel 611 and the second arm channel 613 from each other, a first supply hole 654 configured to make the first arm channel 611 communicate with the lower arm chamber 69, and a second supply hole 656 configured make the first arm channel 613 communicate with the lower arm chamber 69.

The channel partition wall 652 may be provided in the upper frame 63. In some implementations, an upper partition wall provided in the upper frame 63 and a lower partition wall provided in the lower frame 65 may be coupled to each other.

Moreover, a lower injection hole 651 may be further provided in the lower frame 65 to inject the washing water toward the sump cover 15.

The upper injection hole 631 and the lower injection hole 651 may be provided to make the lower arm 6 rotated by a repulsive force of the washing water exhausted there from (see FIG. 6 (*b*)).

The second supply hole 656 may be formed outside an area where the first supply hole 654 is formed.

The lower arm chamber 69 may be provided under the lower frame 65 and it is supplied the washing water from the arm holder 17. The lower arm chamber 69 may include an arm holder connection pipe 697 rotatably coupled to the arm holder 17 and an inlet hole 691 penetrating the arm holder connection pipe to lead the washing water therein.

An upper gear coupling portion 693 may be provided in a top surface of the lower arm chamber 69 (an outer bottom surface of the lower frame 65) and a lower gear coupling portion 695 may be provided in a bottom surface of the lower arm chamber 69.

The upper gear coupling portion 693 is configured to be coupled to an upper gear 97 provided in the channel change unit 9 and the lower gear coupling portion 695 is configured to be coupled to a lower gear 99 provided in the channel change unit 9.

The upper gear coupling portion 693 may be provided in an area located between the area the first supply hole 654 is formed and the area where the second supply hole 656 is formed, to cover (surround) the first supply hole 654.

The lower gear coupling portion 695 may be provided in a bottom surface of the lower arm chamber 69 and cover (surround) the inlet hole 691.

The channel change unit 9 is further provide in the lower arm chamber 69 and it alternately open the first supply hole 654 and the second supply hole 656.

The channel change unit 9 is similar to the channel change unit described above in reference to FIGS. 7 and 8.

In FIG. 7, the channel change unit 9 may include a change unit body 91 formed in a disk shape, a flange 92 provided along an outer circumferential surface of the change unit body 91 to contact with an inner circumferential surface of the lower arm chamber 69, and a first opening hole 93 and a second opening hole 95 penetrating the change unit body 91 to open the first supply hole 654 and the second supply hole 656, respectively.

An upper gear 97 is provided in a top surface of the change unit body 91 to be coupled to the upper gear coupling portion 69 so as to cover (surround) the first opening hole 93. A lower gear 99 is provided in a bottom surface of the change unit body 91 to be coupled to the lower gear coupling portion 695.

When the upper gear 97 is coupled to the upper gear coupling portion 693, the channel change unit 9 is rotated a predetermined angle in a clockwise or counter-clockwise direction.

When the lower gear 99 is coupled to the lower gear coupling portion 695, the rotational direction of the channel change unit 9 when the upper gear 97 is coupled to the upper gear coupling portion 693 is identical to the rotational direction of the channel change unit 9 when the lower gear 99 is coupled to the lower gear coupling portion 695.

In case the first supply hole 654 and the second supply hole 656 provided in the lower arm 6 are spaced apart about 90 degrees from each other as shown in FIG. 14 (*b*), a center of the first opening hole 93 and a center of the second opening hole 95 may be arranged on a straight line or substantially straight line passing the rotational center of the channel change body 91.

In this instance, the upper gear coupling portion 693 and the upper gear 97 may be formed in a predetermined shape to enable the channel change body 91 to rotate about 45 degrees in the clockwise or counter-clockwise direction so as to open a chamber communication hole 655 or an arm channel communication hole 657, when the upper gear 97 is coupled to the upper gear coupling portion.

The lower gear coupling portion 695 and the lower gear 99 may be formed in a predetermined shape to enable the channel change body 91 to rotate about 45 degrees in the clockwise or counter-clockwise direction when the upper gear 97 is coupled to the upper gear coupling portion.

In some implementations, the first opening hole 93 and the second opening hole 95 may be spaced apart about 90 degrees from each other with respect to the rotational center (C) of the change unit body 91. The first supply hole 654 and the second supply hole 656 may be arranged on a straight line.

A change unit guider 96 is further provided in bottom surface of the change unit body 91.

Referring to FIG. 14, an example operational process of an example dishwasher will be described.

When the washing water is not supplied to the lower arm chamber 69 after the water supply pump 18 stops operating, the channel change unit 9 is in contact with the bottom surface of the lower arm chamber 69 (see FIG. 14 (*c*)).

The water supply pump 18 starts operating and the washing water is supplied to the arm holder 17 via the first channel 21. After that, the upper arm 7 and the top nozzle 8 are supplied the washing water via the second channel 23 and the lower arm chamber 69 is supplied the washing water via the arm holder 17.

When the lower arm chamber 69 is supplied the washing water, the channel change unit 9 is moving toward the top surface of the lower arm chamber 69 such that the upper gear 97 may be coupled to the upper gear coupling portion 693.

The motion of the channel change unit 9 may be guided by the change unit guider 96 inserted in the inlet hole 691 and the change unit body 91 may be prevented from losing level in the lower arm chamber 69.

When the upper gear 97 is coupled to the upper gear coupling portion 693, the channel change unit 9 is rotated about 45 degrees and the first opening hole 93 opens the first supply hole 654.

The second supply hole 656 may maintain a state of being closed by the change unit body 91 and the washing water may not be supplied to the second channel 611.

The first supply hole 654 is open by the first opening hole 93 and the washing water is supplied to the first arm channel 611, to inject the washing water to the lower rack 193 and the sump cover 15 via the upper injection hole 631 and the lower injection hole 651, respectively. In this process, the lower arm 6 rotates on its axis of the arm holder connection pipe 697.

Once the water supply pump 18 temporarily stops the operation, the washing water is not supplied to the lower arm chamber 69 and the channel change unit 9 is moving toward the bottom surface of the lower arm chamber 69.

The motion of the channel change unit 9 is guided by the change unit guider 96 inserted in the inlet hole 691 and the change unit body 91 is prevented from losing level in the lower arm chamber 69.

When the channel change unit 9 is moving toward the bottom surface of the lower arm chamber 69, the lower gear 99 is coupled to the lower gear coupling portion 695 and the channel change unit 9 is rotated about 45 degrees in the clockwise or counter-clockwise direction.

Accordingly, the center of the first opening hole 93 and the center of the first supply hole 654 are spaced apart about 45 degrees from each other. Also, the center of the second opening hole 95 and the center of the second supply hole 656 are spaced apart about 45 degrees from each other.

After that, the washing water is re-supplied to the lower arm chamber 69 by the water supply pump 18 and the channel change unit 9 is moving toward the top surface of the lower arm chamber 69, such that the upper gear 97 may be coupled to the upper gear coupling portion 693.

Once the upper gear 97 is coupled to the upper gear coupling portion 693, the channel change unit 9 is rotated about 45 degrees in the clockwise or counter-clockwise direction and the second supply hole 656 is open by the second opening hole 95.

In this instance, the first supply hole 654 maintains the state of being closed by the change unit body 91 and the washing water is supplied to the first arm channel 611.

Once the second supply hole 656 is open by the second opening hole 95, the washing water held in the lower arm chamber 69 is drawn only into the second arm channel 613.

The washing water drawn into the second arm channel 613 is injected to the lower rack 193 and the sump cover 15 via the upper injection hole 631 and the lower injection hole 651, respectively. In this process, the lower arm 6 is rotated on the arm holder connection pipe 697 as its axis.

After that, the water supply pump 18 temporarily stops the operation and the washing water is not supplied to the lower arm chamber 69 such that the channel change unit 9 may be moving toward the bottom surface of the lower arm chamber 69.

When the channel change unit 9 is moving toward the bottom surface of the lower arm chamber 69, the lower gear 99 is coupled to the lower gear coupling portion 695 and the channel change unit 9 is rotated about 45 degrees in the clockwise or counter-clockwise direction.

In this instance, the center of the first opening hole 93 and the center of the first supply hole 654 are spaced apart about 45 degrees from each other. Also, the center of the second opening hole 95 and the center of the second supply hole 656 are spaced apart about 45 degrees from each other.

Accordingly, the plurality of the arm channels 611 and 613 provided on injection arm may be selectively open by the operation of the channel change unit 9.

It will be apparent to those skilled in the art that various modifications and variations can be made in the present disclosure without departing from the spirit or scope of the technology. Thus, it is intended that the present disclosure covers the modifications and variations of this technology provided they come within the scope of the appended claims and their equivalents. In addition to variations and modifications in the component parts and/or arrangements, alternative uses will also be apparent to those skilled in the art.

What is claimed is:

1. A dishwasher comprising:

a tub;

an upper rack and a lower rack arranged in the tub and configured to receive objects;

a lower arm comprising:

a lower arm chamber configured to receive water into the lower arm chamber;

a detachable pipe chamber configured to receive water from the lower arm chamber via a chamber communication hole located in a chamber partition wall that separates the lower arm chamber from the detachable pipe chamber; and an arm channel arranged to receive water from the lower arm chamber via an arm channel communication hole located in the arm channel and configured to eject water to the lower rack;

a water supply pump configured to supply water to the lower arm chamber;

a tower nozzle configured to eject water toward the upper rack;

a tower connection part arranged to supply water received from the detachable pipe chamber to the tower nozzle and being detachable from the detachable pipe chamber; and a channel change unit provided in the lower arm chamber and configured to alternately open (i) the chamber communication hole and (ii) the arm channel communication hole in response to changes in water pressure inside the lower arm chamber, wherein the channel change unit comprises:

a change unit body configured to reciprocate along a straight line and rotate in the lower arm chamber in response to changes in the water pressure inside the lower arm chamber; and a flange that extends around an outer circumferential surface of the change unit body, that is configured to guide the change unit body during reciprocation and rotation by contacting an inner circumferential surface of the lower arm chamber, and that comprises a plurality of projections that are configured to prevent foreign substances from being plugged between the flange and the lower arm chamber.

2. The dishwasher according to claim 1, wherein the channel change unit further comprises:

a chamber opening hole in the change unit body configured to open the chamber communication hole based on a rotational angle of the change unit body; and an arm channel opening hole in the change unit body configured to open the arm channel communication hole based on the rotational angle of the change unit body.

3. The dishwasher according to claim 2, wherein the lower arm chamber comprises:

an inlet hole configured to draw water into the lower arm chamber;

a lower gear coupling portion configured to surround the inlet hole; and an upper gear coupling portion arranged above the lower gear coupling portion, wherein the channel change unit further comprises:

an upper gear that is at a top surface of the change unit body and that is configured to operate one of the chamber opening hole and the arm channel opening hole to open one of the chamber communication hole and the arm channel communication hole when the upper gear is coupled to the upper gear coupling portion; and a lower gear that is at a bottom surface of the change unit body and that is configured to operate another one of the chamber opening hole and arm channel opening hole to open another one of the chamber communication hole and arm channel communication hole when the lower gear is coupled to the lower gear coupling portion.

4. The dishwasher according to claim 3, wherein the channel change unit further comprises:

a change unit guider extended from the bottom surface of the change unit body toward the inlet hole and configured to guide the change unit body during reciprocation.

5. The dishwasher according to claim 4, wherein one or more additional change unit guiders are in the bottom surface of the change unit body, and the one or more additional change unit guiders are separated a predetermined distance from a rotational center of the change unit body.

6. The dishwasher according to claim 5, wherein the change unit guider is configured to remain inserted in the inlet hole independent of the upper gear being coupled to the upper gear coupling portion.

7. The dishwasher according to claim 1, wherein the tower nozzle comprises:

a tower channel having a first end fixed to the lower rack and a second end extended toward the upper rack;

an injection nozzle rotatably coupled to the tower channel and configured to eject water supplied from the tower channel toward the upper rack;

a downward injection channel configured to eject water held in the injection nozzle toward the lower rack; and a downward injection guider configured to spray water ejected from the downward injection channel toward the lower rack;

wherein the water supply pump is configured to supply water to the tower channel, wherein the downward injection channel is located in a first coupling space between the tower channel and the injection nozzle, and wherein the downward injection guider is located at an upper end of the tower channel and below the injection nozzle.

8. The dishwasher according to claim 7, wherein the injection nozzle further comprises:

a connection pipe coupled to the tower channel and configured to rotatably support the injection nozzle against the tower channel; and an injection hole configured to eject water from the tower channel to the upper rack, and wherein the downward injection channel is in a second coupling space between the connection pipe and the tower channel.

9. The dishwasher according to claim 8, wherein the downward injection channel is in a groove provided in one of the connection pipe and the tower channel to eject water from the injection nozzle.

10. The dishwasher according to claim 7, wherein the downward injection guider comprises:

a guider body that includes a channel penetrating hole configured to accept the tower channel;

a blade that is in a rotational center of the guider body and extending toward an edge of the guider body, the blade being configured to rotate the guider body based on water being expelled from the downward injection channel.

11. The dishwasher according to claim 10, wherein one or more additional blades are on the guider body, and the one or more additional blades are curved and rotationally symmetrical to a center of the guider body.

12. The dishwasher according to claim 11, wherein the downward injection guider further comprises:

an outlet hole that is between two blades on the guider body and configured to penetrate the guider body; and wherein the outlet hole extends a predetermined length away from the rotational center of the guider body to the edge of the guider body.

13. The dishwasher according to claim 10, wherein the downward injection guider further comprises:

a bent groove between two blades on the guider body, the bent groove formed by recessing an outer circumferential surface of the guider body toward the rotational center of the guider body.

14. The dishwasher according to claim 7, wherein the downward injection guider is in a lower portion of the downward injection channel along an outer circumferential surface of the tower channel and is in an annular shape.

* * * * *